US005140295A

United States Patent [19]

Vermot-gaud et al.

[11] Patent Number: 5,140,295

[45] Date of Patent: Aug. 18, 1992

[54] FUSE

[75] Inventors: Jacques Vermot-gaud, Perly; Georges Melet, Meyrin; Bogdan Zega, Geneva, all of Switzerland

[73] Assignee: Battelle Memorial Institute, Switzerland

[21] Appl. No.: 694,970

[22] Filed: May 6, 1991

[30] Foreign Application Priority Data

May 4, 1990 [CH] Switzerland ..... 01519/90

[51] Int. Cl.[5] ..... H01H 85/04

[52] U.S. Cl. ..... 337/297; 29/623

[58] Field of Search ..... 337/297; 29/623

[56] References Cited

U.S. PATENT DOCUMENTS

| | | | |
|---|---|---|---|
| 4,272,753 | 6/1981 | Nicolay | 337/297 |
| 4,749,980 | 6/1988 | Morrill, Jr. et al. | 337/297 |
| 4,873,506 | 10/1989 | Gurevich | 337/297 |
| 5,027,101 | 6/1991 | Morrill, Jr. | 337/297 |

OTHER PUBLICATIONS

IEEE Proceedings, vol. 132, Pt 1, No. 3, Jun. 1985—Temperature Measurements of Thin Films on Substrates by D. deCogan et al—pp. 143-146.

Microelectronics Centre, School of Electronic Engineering South Australian Institute of Technology, "High Speed Thick Film Fuses" by A. J. Marriage and B. NcIntosh—pp. 15-17.

*Primary Examiner*—Harold Broome

[57] ABSTRACT

An elongated substrate made of an electric insulating material carries an elongated conductive track made of aluminium which has a constriction in its centre part in order to increase the heating of the said centre part with a view to reducing as much as possible the volume of material to melt. The ends of the track each comprise an annular part which partially covers a nickel or aluminium pad. The connection and cooling of the ends is carried out by connection brackets. This fuse is calculated in such a way that for a rated current IN, a maximum temperature variation ΔT and a length of the electric conductor designated *2b*, thermal equilibrium is obtained when the relationship between the cross section S of the said conductor and that S' of the base material corresponds approximately to:

$$S=\rho'_{th}.\rho_e.b^2.IN^2/2S'.\Delta Tmax$$

where $\rho'_{th}$ is the thermal resistivity of the substrate and $\rho_e$ the electrical resistivity of the conductive track.

11 Claims, 1 Drawing Sheet

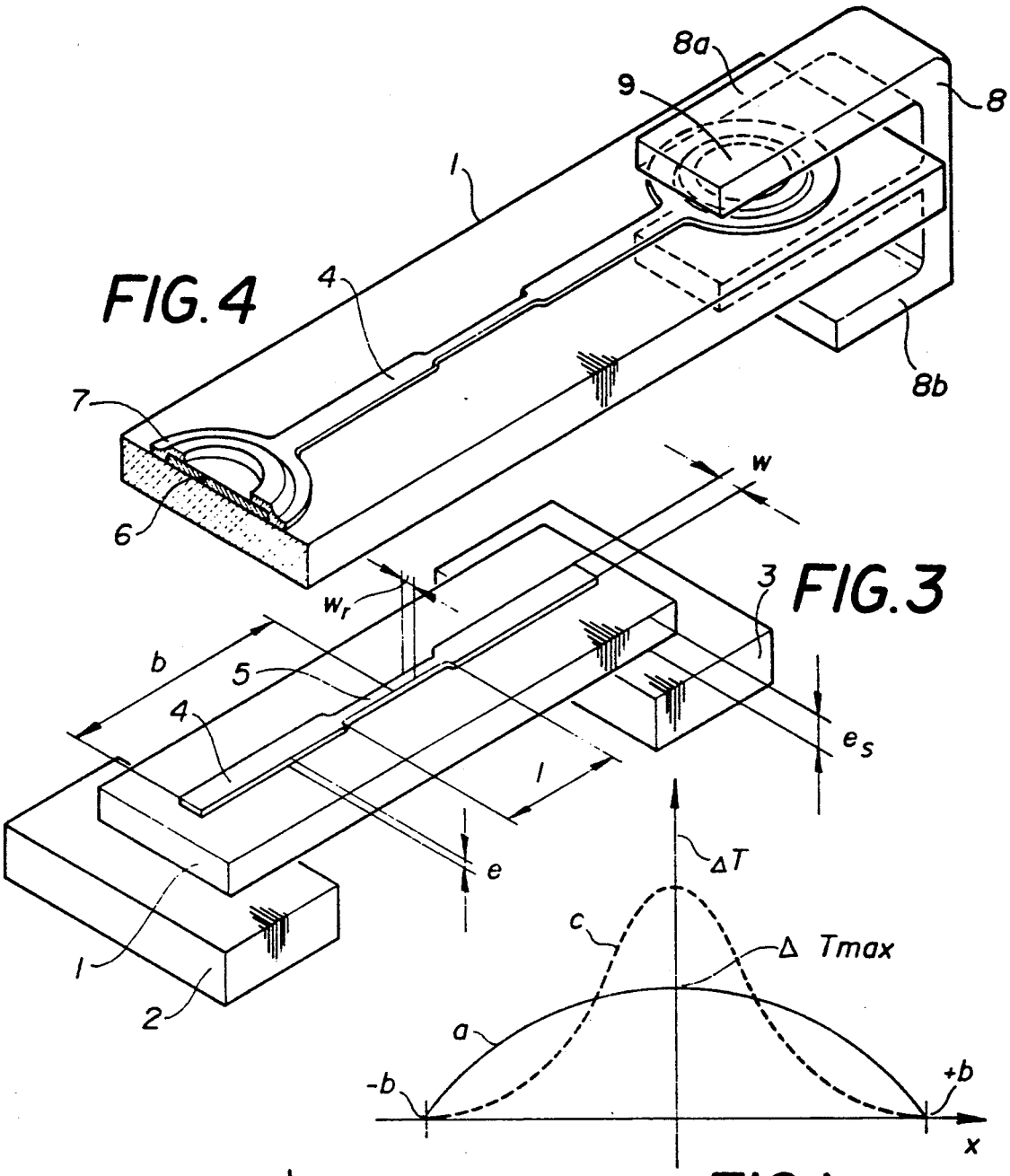
FIG. 4
FIG. 3
FIG. 1
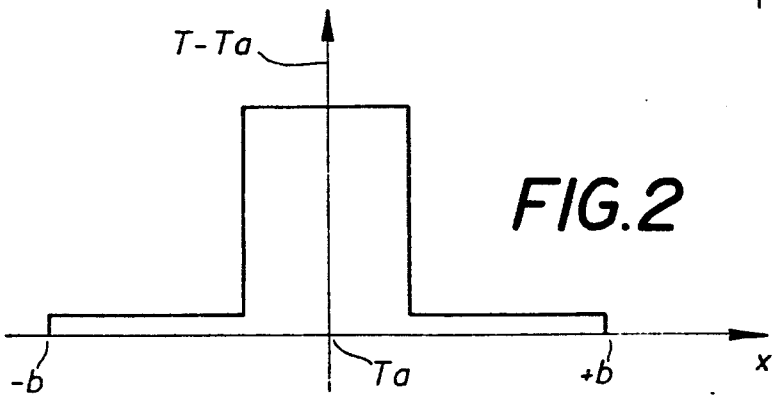
FIG. 2

FUSE

BACKGROUND OF THE INVENTION

The present invention relates to a fuse comprising an elongated electric conductor in the form of a thin film deposited on the surface of an elongated electric insulating substrate.

DISCUSSION OF THE PRIOR ART

Taking into account the low thermal capacity of conductors and of the junctions of semi-conductors, fuses for protecting electronic circuits must be very high-speed and allow little energy to pass. To this end, replacing conventional fuses, which comprise a wire mounted in a glass tube and which are not suitable for miniature hybrid circuits, by fuses compatible with surface-mounted component technology and in which the electric conductor element comprises a track deposited on a substrate, has already been suggested. A solution of this type has been described in an article published in "Hybrid Circuits", No. 9, January 1986, under the title "High Speed Thick Film Fuses", p. 15–17, by A. J. Marriage and B. McIntosh.

The disadvantages of using thick film technology for the manufacture of fuses are numerous. The thickness is by definition important and the width of the deposit cannot fall with accuracy below 0.15mm to 0.2mm. The regularity and the reproducibility of the layers do not allow absolute values to be guaranteed with acceptable accuracy. Thick films cannot in particular cover a range, typically from 10mA to 10A, which corresponds to the totality of requirements in the field of electronic circuits. Furthermore, this technology can only form layers which are non-metallic and therefore resistive. For all these reasons, the fuses obtained by serigraphy cannot respond to the problems posed by the protection of electronic circuits since they are not suitable for creating a product covering all the currents used in such circuits.

Simulating the behaviour of a fuse on a silica or alumina substrate in order to measure the temperature profiles during the different operating phases of the fuse has also been suggested in the article "Temperature measurements of thin films on substrates", published in IEE Proceedings, Vol. 132, Pt. 1, No. 3, June 1985, pages 143–146. This article studies in particular the effect of the time constant of the substrate on the energy to be provided in order to obtain the fusion temperature, showing the superiority of alumina over other ceramics, taking into account its reduction in thermal conductivity with increasing temperature, which reduces the energy needed to obtain fusion and thus increases the speed of the fuse.

U.S. Pat. No. 4,272,753 relates to a fuse for an integrated circuit wherein a conductive track is deposited on a substrate which is then removed below the medial part of the said conductive track in order to suppress the effect of the substrate on the behaviour of the fuse. Producing a fuse such as this poses complex technological problems which, taking into account the very low permissible cost prices for this type of product, necessitates solutions which are ill-suited from an economic point of view, because customers are not prepared to pay for a fuse at the price of a transistor, for example.

SUMMARY OF THE INVENTION

The aim of the present invention is to at least partially remedy the disadvantages of the above solutions.

To this end, the subject of this invention is a fuse comprising an elongated electric insulating substrate of cross section S' and elongated electric conductor of cross section S in the form of a thin film deposited on the surface of said elongated electric insulating substrate characterized in that the dimensions and materials of the substrate and conductor are selected such that for a rated current designated IN, a predetermined maximum temperature variation along the conductor designated ΔTmax, and a length of the electric conductor designated 2b, thermal equilibrium is obtained, when the said rated current flows along said conductor, when the relationship between the cross section S of the said electric conductor and the cross section S' of the substrate is approximately:

$$S=\rho'_{th}\rho_e b^2 IN^2/2S'\ \Delta Tmax$$

where $\rho'_{th}$ is the thermal resistivity of the substrate and $\rho_e$ is the electrical resistivity of said electric conductor and in that the said conductor has respective opposite end regions and the substrate has respective opposite end regions adjacent thereto and a medial region therebetween, and there is a thermal resistivity between ambient temperature and each said end region of the substrate which is <200° C./W whereas there is a thermal resistivity>500° C./W between the ambient temperature and said medial region of the said substrate, the value of ΔTmax being chosen sufficiently high that said thermal equilibrium is broken in <1s when the current flowing along said conductor reaches 2IN.

The advantages of the fuse of the invention are numerous. This fuse is perfectly adapted to the surface-mounted types of electronic components. The technology of thin film deposition lends itself particularly well to the large-scale production of articles. Using a thin, narrow film leads to a very low volume of metal to melt. The presence of the base material on which the conductive film is deposited contributes to the cooling of the film at the rated current without being detrimental to the speed of disconnection for multiples of the said rated current. This solution makes it possible to produce with the same technology a range of fuses adapted to all the currents encountered in electronic circuits, typically between 10mA and 10A, without this constituting a limitation of the fuse itself.

BRIEF DESCRIPTION OF THE DRAWINGS

The description which follows and the accompanying drawing illustrate very schematically and by way of example an embodiment of the fuse of the present invention.

In the drawings:

FIG. 1 is a diagram of the temperature distribution along a fuse of the invention.

FIG. 2 is another diagram of the temperature distribution along a fuse of the invention.

FIG. 3 is a greatly enlarged perspective view of the active part of a fuse of the invention, and FIG. 4 is a perspective view, partly cutaway, of a fuse according to one embodiment of the invention.

DESCRIPTION OF PREFERRED EMBODIMENTS

In order to produce a very high-speed miniature fuse designed in particular to protect electronic circuits, the dissipated power and the voltage drop must, from an electrical point of view, be as low as possible. This means that the resistance and therefore the dissipated power are lower than a limit value which is a function of the rated current IN. Table 1 below gives the typical values of present miniature fuses.

TABLE 1

| IN (A) | V (mV) | RN (ohm) | PN (watt) | |
|---|---|---|---|---|
| 0.04 | 8000 | 200 | 0.32 | |
| 0.1 | 3500 | 35 | 0.35 | High- |
| 0.2 | 1700 | 8.5 | 0.34 | Speed |
| 0.5 | 1000 | 2 | 0.5 | Fuses: F |
| 1 | 200 | 0.2 | 0.2 | |
| 2 | 370 | 0.185 | 0.74 | |
| 4 | 280 | 0.07 | 1.12 | Very High- |
| 5 | 250 | 0.05 | 1.25 | Speed |
| 8 | 250 | 0.031 | 2 | Fuses: FF |
| 10 | 250 | 0.025 | 2.5 | |

At the technical level, the fuse must remain indefinitely at a temperature below the fusion temperature of the conductor or a temperature which is likely to reduce performance, for a current lower than or equal to 1.4 times the rated current IN.

The fusion temperature of the conductor must be reached in $\leqq 1$ second for a current of 2IN and in $\leqq 10$ ms for a current of 4IN.

This means that at 1.4IN, a state of equilibrium is established between the cooling power and the dissipated power, which clearly assumes that this dissipated power is removed by conduction through the base material or substrate of the conductive film towards the outside. The dissipated energy must be infinite over an infinite period.

In the dynamic state, i.e. at 2IN and at 4IN, the dissipated energy must be finite. It corresponds to the heating energy of the metallic film and of the substrate, to which energy the cooling energy is added.

The more the heating energy of the film and of the substrate is reduced, the more rapidly the finite dissipated energy is obtained. This assumes on the one hand a reduction in the volume of material to melt and a choice of substrate material with sufficiently low density and specific heat, and on the other hand a reduction in the conduction of heat towards the outside, which conflicts with the state of equilibrium in which the dissipated power must be removed by conduction.

In order to reconcile the conditions of the dynamic state and of the equilibrium state of the fuse, the metal film constituting the fuse and its substrate must be elongated and the conduction of heat must pass through the two ends of the elongated substrate, the temperature of which ends must remain at a constant value. To this end, the thermal resistivity between ambient temperature and each end of the support should be $<200°$ C./watt, while that between ambient temperature and the median part of the support should be $>500°$ C./watt. In these conditions, and in as much as the power lost by radiation and convection is sufficiently low, which is the case, the temperature distribution along the conductive film follows a parabolic law, as shown by the curve $\alpha$ in FIG. 1, with the result that the temperature of this elongated conductor is higher at the centre. The value of $\Delta T_{max}$ is chosen to be high enough that the equilibrium is broken in a manner corresponding to the requirements set out below, relative to the speeds of interruption of the current.

In order to increase the effect of concentration of the heating at the centre of the elongated conductive film, a constriction is arranged there. For times $\leqq 1$ second, the temperature distribution reflects this constriction, as shown by the curve c in FIG. 1. For times $\geqq 1$ second, the distribution becomes parabolic again thanks to the presence of the substrate.

FIG. 3 shows a fuse produced according to the general principles which have been set out above. In this FIGURE, an elongated substrate made of an electric insulating material 1 can be seen, the two ends of which rest on two supports 2 and 3 designed to remove the heat produced in the state of equilibrium towards the atmosphere. This substrate carries an elongated conductive metal track 4 which has a constriction 5 in its centre part in order to increase the heating effect of this centre part with a view to reducing as much as possible the volume of material to melt and giving it almost adiabatic properties in the dynamic heating state. By decreasing the cross section of the conductive track by reducing its width, the area of heat exchange with the substrate is decreased at the same time, at least in the dynamic state, and dynamic insulation of the constriction 5 is thus obtained, the maximum temperature variation then being typically between 4 and 10 times higher than the average temperature, as shown by the diagram in FIG. 2. In this way it becomes possible to reach the fusion temperature for a current of 4IN in a time in the order of $<1$ ms and with a current of 2IN in a time in the order of 200 ms to 600 ms. Preferably, the degree of constriction of the metal film is 30% to 70%, for a film of constant thickness.

Having dealt with the major options with a view to obtaining a fuse of the very high-speed type (FF) designed in particular to protect electronic circuits, we are now going to examine the dimensioning of this fuse.

S is the largest cross-section with a width w of the metallic track 4, the thermal resistivity of which is $\rho_{th}$, and S' is the cross-section of the electrically insulating substrate 1, the thermal resistivity of which is $\rho'_{th}$.

The law of parabolic distribution of the temperature in a state of equilibrium (FIG. 1), without taking into account the substrate 1, a possible restriction of losses by radiation and convection, and the temperature coefficient of electrical resistivity $\rho_e$, is:

$$\Delta T = T - T_a;\ T_a = \text{ambient temperature}$$

$$T = T_a + \rho_{th} \cdot \rho_e \cdot IN^2 \cdot (b^2 - x^2)/2S^2$$

$\rho_{th}$ = thermal resistivity of the metal
S = cross-section of the conductive track 4 (in the case of a track without a constriction)
IN = rated current
b = half-length of the metal track
x = distance along the track from its centre If x = 0:

$$T_{max} - T_a = \Delta T_{max} = \rho_e \rho_{th} \cdot IN^2 b^2 / 2S^2$$

For a given value of $\Delta T_{max}$, the value of S is:

$$S^2 = \frac{\rho_e \rho_{th}}{2\Delta T_{max}} \cdot b^2 \cdot IN^2 \qquad (1)$$

In the presence of the substrate of cross section S' and of thermal resistivity $\rho'_{th}$ it can be considered that everything takes place as if there were a metal of thermal resistivity $\rho''_{th}$ such that:

$$\frac{S}{\rho''_{th}} = \frac{S}{\rho_{th}} + \frac{S'}{\rho'_{th}}$$

The relationship (1) giving $S^2$ becomes:

$$S^2 = \frac{\rho_e \rho''_{th}}{2\Delta T_{max}} \cdot b^2 \cdot IN^2 \quad (1)$$

Since $\rho''_{th}$ is a function of S, this relationship is in fact an equation of the second degree in S, one of the solutions of which equation gives the cross section of metal for a current IN.

For values of IN typically $\leqq$10A, the relation between the cross section S of the conductor and that of the substrate corresponds closely to:

$$S = \rho'_{th} \cdot \rho_e \cdot b^2 \cdot IN^2 / 2S' \cdot \Delta T_{max}$$

EXAMPLE 1

| | | | | | |
|---|---|---|---|---|---|
| | Track: | | $2b = 9.10^{-3}$ m | | |
| | Substrate: | | $S' = 0.6$ mm$^2$ | | |
| | Glass: | | $\rho'_{th} = 0.7°$ C. m/W | | |
| | Ceramic: | | $\rho'_{th} = 0.07°$ C. m/W | | |
| | glass | | ceramic (sintered alumina) | | |
| IN (A) | 0.04 | 0.4 | 0.4 | 4 | 10 |
| S ($\mu^2$m) | 1.5 | 150 | 15 | 1500 | 9375 |
| R (ohm) | 180 | 1.8 | 18 | 0.18 | 0.029 |
| P (W) | 0.29 | 0.29 | 2.9 | 2.9 | 2.9 |

Having examined the dimensioning for a period which is very long (rated current), it is important to examine the effects which result for the very short period where the current is four times the rated current, i.e. 4IN.

As will be seen later, the dimensioning for a very short period is very dependent on the cross section of the conductive track and on its width which affects the area of heat exchange with the substrate as a function of the thermal resistance between the conductive track and the whole of the substrate. Given that the thickness of the track is constant, a constriction of the initial cross section, which entails a concentration of power per unit of length, necessarily results in a decrease in the width of the track, and therefore a reduction in the area of heat exchange at the point where the dissipated power is the highest.

We are now going to see the effects of the presence of a constriction along the conductive track. The thermal resistance between the metallic film and the whole of the substrate can be expressed in an approximate manner with the aid of the expression:

$$R_{th} = \rho_{th} \cdot \frac{1}{\pi l_r} \cdot \mathrm{Ln}(e_s/w_r)$$

where $e_s$ is the thickness of the substrate $w_r$ is the width of the track at the point of the constriction $l_r$ is the length of the constriction.

The difference in temperature between the film and the substrate is:

$$\Delta T = R_{th} \cdot P$$

It will be assumed that the track is made of aluminium. P is the power dissipated in the constriction of the conductive track. The temperature has to reach the fusion temperature of aluminium (>600° C.). In these conditions, the power P to be taken into account depends on the resistivity of aluminium at this temperature.

$$P = \rho_e \cdot \frac{1}{S_r} \cdot (4IN)^2$$

where $\rho_e$ is the conductivity at 600° C. and $S_r$ the cross section of the constriction.

$$T = \rho'_{th} \cdot \frac{1}{\pi l_r} \cdot \mathrm{Ln}(e_s/w_r) \cdot \rho_e (l_r/S_r)(4IN)^2 = \frac{\rho'_{th} \cdot \rho_e}{\pi} \cdot 16IN^2 \cdot \frac{1}{S_r} \cdot \mathrm{Ln}(e_s/w_r) \quad (3)$$

EXAMPLE 2

$T \geqq 600°$ C. for aluminium $\rho_e$ at 600° C.$\simeq 3.10^{-8}(1+4.10^{-3} \cdot 600) = 1.02 \cdot 10^{-7}$ (temperature coefficient $\alpha$ aluminium $4.10^{-3}$/° C.)

$\rho'_{th}$ glass: 0.7° C. m/W $\rho'_{th}$ ceramic: 0.07° C. m/W $e_s$: $0.3 \cdot 10^{-3}$ m By using the data in example 2, in the relationship (3) above, it is possible to determine $w_r$ with the aid of the following expressions in the case of glass and ceramic:

glass: $\mathrm{Ln}(e_s/w_r) = 1.275 \cdot 10^9 \cdot (S_r/IN^2)$ ceramic: $\mathrm{Ln}(e_s/w_r) = 1.275 \cdot 10^{10} \cdot (S_r/IN^2)$ Finally, by fixing the value of $S_r$, i.e. of the cross section of the constriction to S/1.5 for low ratings (in the case of glass) and to S/3 for high ratings (in the case of ceramic), the limit values for $w_r$ are obtained:

| | glass | | ceramic (sintered alumina) | | |
|---|---|---|---|---|---|
| IN (A) | 0.04 | 0.4 | 0.4 | 4 | 10 |
| S ($\mu^2$m) | 1.5 | 150 | 15 | 1500 | 9375 |
| $S_r$ ($\mu^2$m) | 1 | 100 | 5 | 500 | 3125 |
| w ($\mu$m) | <195 | <195 | <2250 | <2250 | <750 |
| $w_r$ ($\mu$m) | <130 | <130 | <750 | <750 | <750 |

The corresponding values of the width w of the track are given below if the said track has no constriction.

| | glass | | ceramic | | |
|---|---|---|---|---|---|
| IN (A) | 0.04 | 0.4 | 0.4 | 4 | 10 |
| w ($\mu$) | <90 | <90 | <90 | <90 | <90 |

As can be seen, the presence of the constriction has an effect on the maximum permissible width of the conductive track, all the more as the current is increased and if the substrate has a thermal resistivity. However, it can be seen that for a current of 10A, the thickness of the track is 4.1 $\mu$m, whereas without a constriction this thickness would be greater than 1 mm for a maximum width of 90 $\mu$, which would be unthinkable, even in serigraphy. On the contrary, with the constriction a thickness of 4.1 $\mu$m is not exceeded for a current of 10A, which means that all fuses from 0.04A to 10A and more can be produced with the same method of thin film deposition.

It can be seen that the constriction concentrates the dissipated power to a certain extent owing to the fact that the cross section for flow of the current is less.

The concentration of power is sufficiently great in itself to reach the fusion temperature, with the result that it makes it possible to have a lower thermal resistance between the substrate and the conductive track and therefore a greater width of the whole of the said conductive track in relation to that which a track without constriction would allow. As the comparative examples show, it is therefore a question of a characterisation of the present invention which becomes essential at least above 0.5A since it affects the possibility of producing high-speed fuses and very high-speed fuses on substrates and for currents of 0.5 amps to 10 amps and even beyond that, since it appears that 10A does not constitute a limit of the field of application of the invention, even with the same method of manufacture.

Taking into account the preceding information relating to dimensioning, we are now going to study the heating time for this same current of 4IN. Everything takes place as if, between the conductive track, which must reach 600° C. in the case of aluminium, and the substrate, there were a thermal capacity $C_{th}$ defined by the formula (4):

$$C_{th}=K_{th}\cdot D\cdot S_r l_r \quad (4)$$

where $K_{th}$ is the specific heat of the metal and D is its density.

$R_{th}\cdot C_{th}$ corresponds to the time constant of the fuse and with formulae (2) and (4) therefore gives $$R_{th}C_{th} = \rho_{th}\cdot\frac{1}{\pi l_r}\cdot \mathrm{Ln}(e_s/w_r)\cdot K_{th}\cdot D\cdot S_r\cdot l_r$$
$$= \frac{1}{\pi}\cdot\rho_{th}\cdot K_{th}\cdot D\cdot S_r\cdot \mathrm{Ln}(e_s/w_r)$$

EXAMPLE 3

$\rho_{th}$ aluminium $=4.6\cdot10^{-3}$° C. m/watt;
$K_{th}=945$ Joules/kg; $D=2{,}700$ kg/m$^3$
$\mathrm{Ln}(e_s/w_r)=5$, $R_{th}C_{th}=18.7\cdot10^{-3}\,S_r$ Referring to the table in example 2, the time constant is $1.9\cdot10^{-8}$ for 0.04A, $1.9\cdot10^{-6}$ for 0.4A on a glass substrate, and on an alumina substrate, $9\cdot10^{-8}$ for 0.4A, $9\cdot10^{-6}$ for 4A and $5.8\cdot10^{-5}$ for 10A. By allowing a heating time equal to $10R_{th}C_{th}$, the longest time is in the order of 0.6 ms, i.e. well below one ms for four times the rated current of 10A.

Tests have been carried out with fuses dimensioned according to the information given above. These tests have also shown that for a current of 2IN, disconnection occurs for times in the order of 200ms to 600ms, i.e. well below one second. Consequently, it is thus shown that it is entirely possible to produce a very extended range of fuses covering in practice all the currents used in electronic circuits and meeting the criteria of very high-speed fuses (FF) by adopting a technology which is fully adapted to surface-mounted components, generally known as SMC; the conditions which enable the demands of FF fuses to be satisfied over a range which is also extended by the method of thin-film deposition are, on the one hand, the fact of forming an elongated track on an elongated substrate, the fact of cooling the substrate by way of its ends and, on the other hand, at least above 0.5A, the presence of a constriction of cross section which, the layer being of uniform thickness, is represented by a reduction in width.

We are now going to examine the technological problems and their solutions.

The choice of metal used for the conductive track formed as a thin layer on the substrate is affected by the following criteria: low resistivity, a high temperature coefficient $\alpha$, good oxidation stability, a melting point between 600° C. and 1,500° C., good adhesion to the substrate and a possibility of connection by normal methods.

From amongst these criteria, adhesion is obviously that which takes priority since it is an essential condition. Given that alloys have a higher resistivity and a lower thermal coefficient of increasing resistivity as a function of temperature than pure metals, the latter are preferable.

The table below gives the different properties of a number of possible metals as conductive track.

TABLE 2

| | $\rho(10^{-6}$ Ω cm) | $\alpha$ ($\times 10^{-3}$/°C.) | Stability | Melting Point (°C.) | Adhesion | Fixing |
|---|---|---|---|---|---|---|
| Al | 2.6 | 3.9 | + | 660 | ++ | −(+indir) |
| Ni | 6.9 | 4.7 | + | 1453 | +− | + |
| Cr | 12.9 | — | + | 1890 | ++ | −+indir |
| Au | 2.4 | 3.4 | ++ | 1060 | − | ++ |
| Ag | 1.6 | 3.9 | +− | 960 | − | ++ |

Concerning the substrate, which will be mineral, either glass or ceramic, the selection criteria are again adhesion and the price, which must be low, fuses being a cheap electrical component. Surface roughness must be sufficiently low, it must be possible to break, to cut or to saw the substrate in order to separate the fuses from each other. The thickness must be able to be as little as 0.3mm and the thermal conductivity must be as low as possible, above all for fuses above 0.5A. In the case of a ceramic substrate, the latter can be advantageously vitrified in order to reduce surface roughness.

As can be seen in the preceding examples, the preferred metal is aluminium on a glass or ceramic substrate. In fact, aluminium is shown to be the best candidate, pure silver adhering badly to the chosen substrates and with the method of deposition used. In order to solve the problem of the connection of the aluminium fuse, various solutions exist. When this connection has to be produced by tin soldering, one solution, as shown in FIG. 4, consists in first of all arranging at each end of the substrate a nickel pad 6 which is then covered by an annular layer of aluminium 7, arranged at the two ends of the conductive track 4, and the inside diameter of which is smaller than that of the nickel pad 6, whilst the outside diameter is greater than that of the said pad 6, with the result that the said annular layer of aluminium 7 guarantees the adhesion of the nickel pad 6 and that it is then possible to carry out the connection of the fuse by tin soldering, by soldering the connecting element at the centre of the annular layer 7 onto the nickel pad 6.

In the case of tin soldering the connections and taking into account the remelting of the tin when the fuse is fixed on a printed or hybrid circuit, one may consider producing the connection with the aid of a clip 8 of the type sold by Comatel Issy-les-Moulineaux (France), the two arms of which sandwich the substrate 1, the upper arm 8a of the said clip 8 being soldered to the nickel pad 6 by the tin 9. When the fuse is fixed to a circuit, for example by soldering the lower surface of the fixing bracket 8b of the clip 8, the remelting of the tin is not likely to cause unsoldering of the clip 8, the latter holding mechanically, and the solder is retained around the arm 8a by the surface tension of the molten metal around the said arm 8a.

It is also possible to carry out aluminium-aluminium ultrasonic soldering with the aid of the same type of clip. In this case, the bracket 8a of the clip 8 is covered with aluminium in order to enable it to be fixed to the layer of aluminium 7 and the fixing bracket 8b of the said clip 8 is tin-plated in order to enable it to be fixed on the circuit. If the track 4 is less than 10 μm thick, the ends can be reinforced with pads 6, not of nickel, but of aluminium.

Obtaining conductive tracks and pads is the result of a physical vapour-phase deposition process carried out in vacuo, preferably by the method of cathodic sputtering of the metal of a target, condensation forming on the substrate placed opposite the said target. Thermal evaporation is also possible, either from a metal melted in a suitable boat heated by the Joule effect or from a metal melted by the beam delivered by an electron gun (in this case, the metal is contained in a cooled crucible).

For the deposition of the pads 6, it is sufficient to cover the substrate with a mask having openings, the shape of which is that desired for the pads; a mask of this type has a large number of these openings so that a whole series of pads can be simultaneously deposited on the substrate.

The deposition of the conductive layer, on the other hand, is carried out on the whole surface of the substrate and covers in particular the pads 6; this layer is then photoetched by a conventional method consisting of opening windows in a thin layer of photosensitive lacquer (hereinafter called photoresist) spread over the conductive layer, then effecting wet etching, i.e. a selective chemical attack on the conductive layer, the parts protected by the photoresist not being attacked, with the result that at the end of the etching the conductive tracks exist according to the high-precision designs made on the photoetching mask and which determine the desired geometries of the fuses.

The remainder of the photoresist is then simply removed by dissolution in an appropriate solvent.

The methods of forming the thin layers in vacuo and of their photoetching by the wet method being well known, we will not enter into these processes in more detail.

Taking into account the large number of pads deposited at the same time, the large number of conductive tracks etched simultaneously, the thicknesses to be deposited and the possibility of accelerating the deposition process by using a magnetic field formed at the surface of the target by a plane magnetron, the deposition speeds are entirely suited to producing fuses at an economically and commercially attractive cost.

One of the quite surprising results of this invention lies in the fact that, contrary to what was logically foreseeable, the presence of the substrate does not reduce performance at all and even seems to improve it. The deposition method used enables great precision and above all great regularity of the thickness of the layer to be achieved, with the result that the fuses thus obtained have an excellent reproducibility. In practice and as shown by the example in FIG. 4, the connection clips 8 can advantageously also be used to remove the heat in the operating state up to 1.4 times the rated current IN.

What is claimed is:

1. A fuse comprising an elongated electric insulating substrate of cross section S, and elongated electric conductor of cross section S in the form of a thin film deposited on the surface of said elongated electric insulating substrate characterized in that the dimensions and materials of the substrate and conductor are selected such that for a rated current designated IN, a predetermined maximum temperature variation along the conductor designated ΔTmax, and a length of the electric conductor designated 2b, thermal equilibrium is obtained, when the said rated current flows along said conductor, when the relationship between the cross section S of the said electric conductor and the cross section S' of the substrate is approximately:

$$S=\rho'_{th}\cdot\rho_e\cdot b^2\cdot IN^2/2S'\cdot\Delta Tmax$$

where $\rho'_{th}$ is the thermal resistivity of the substrate and $\rho_e$ is the electrical resistivity of said electric conductor and in that the said conductor has respective opposite end regions and the substrate has respective opposite end regions adjacent thereto and a medial region therebetween, and there is a thermal resistivity between ambient temperature and each said end region of the substrate which is <200° C./W whereas there is a thermal resistivity >500° C./W between the ambient temperature and said medial region of the said substrate, the value of ΔTmax being chosen sufficiently high that said thermal equilibrium is broken in <1s when the current flowing along said conductor reaches 2IN.

2. A fuse according to claim 1, characterised in that the film forming the elongated electric conductor has intermediate its ends, at the point of ΔTmax, a region comprising a reduction in the width of the film, whereby the cross section of the film is constricted, the cross section of the said constricted region being chosen such that an approximately parabolic temperature distribution along the length of the said conductor is obtained when a current ≦1.4IN is applied for an infinite period, and the conductor exhibits almost adiabatic behaviour when higher currents are applied.

3. A fuse according to claim 2, characterised in that the film is of constant thickness and the degree of constriction is between 30% and 70%.

4. A fuse according to claim 1, characterised in that the thin film is made of aluminium.

5. A fuse according to claim 4, further comprising a thicker metal pad provided on said substrate adjacent each end of the said electric conductor, said conductor comprising at each end a part partially covering a said pad.

6. A fuse according to claim 5, characterised in that said metal pad is made of nickel.

7. A fuse according to claim 5, characterized in that said metal pad is made of aluminium.

8. A fuse according to claim 1 characterised in that the substrate is made of glass.

9. A fuse according to claim 1 characterised in that the substrate is made of vitrified sintered $Al_2O_3$.

10. A method for manufacturing electrical circuit fuses having accurate high speed fusing characteristics over a range of rated currents IN from approximately 10 milliamperes to approximately 10 amperes, said method comprising the steps of:

vapor-phase vacuum depositing a thin film of metal less than 10 μm thickness on an insulating substrate; and photoetching said thin film of metal to form an elongated electric conductor of length $2b$ and cross section S on an elongated insulating substrate of cross section S' wherein for a predetermined maximum temperature variation ΔTmax along the conductor at thermal equilibrium, the following relationship is at least approximately satisfied:

$$S=\rho'_{th}\cdot\rho_e\cdot b^2\cdot IN^2/2S'\cdot\Delta Tmax$$

where $\rho'_{th}$ is the thermal resistivity of the substrate and $\rho_e$ is the electrical resistivity of the electric conductor, wherein there is a thermal resistivity of less than 200° C./W between ambient temperature and each end region of the substrate and a thermal resistivity of more than 500° C./W between ambient temperature and a medial region of said substrate, and wherein the value of ΔTmax is sufficiently high to break thermal equilibrium in less than one second when current flowing along said conductor reaches 2IN.

11. An electrical fuse having accurate high speed fusing characteristics at a rated current IN within the range of approximately 10 milliamperes to 10 amperes, said fuse comprising:

an elongated insulating substrate of cross section S';

an elongated thin-film vapor-phase vacuum deposition of metal disposed on said substrate, said thin film metal having a thickness of less than 10 μm, a length $2b$, a cross section S and a maximum temperature variation ΔTmax therealong which, when at thermal equilibrium at least approximately satisfies the following relationship:

$$S=\rho'_{th}\cdot\rho_e\cdot b^2\cdot IN^2/2S'\cdot\Delta Tmax$$

where $\rho'_{th}$ is the thermal resistivity of the substrate and $\rho_e$ is the electrical resistivity of the electric conductor, wherein there is a thermal resistivity of less than 200° C./W between ambient temperature and each end region of the substrate and a thermal resistivity of more than 500° C./W between ambient temperature and a medial region of said substrate, and wherein the value of ΔTmax is sufficiently high to break thermal equilibrium in less than one second when current flowing along said conductor reaches 2IN.

* * * * *